US009532684B2

(12) United States Patent
Hoefte et al.

(10) Patent No.: US 9,532,684 B2
(45) Date of Patent: Jan. 3, 2017

(54) WET/DRY SHEET DISPENSER AND METHOD OF USING

(71) Applicant: The Procter & Gamble Company, Cincinnati, OH (US)

(72) Inventors: Paulus Antonius Augustinus Hoefte, Astene (BE); Olga Lahuerta Salas, Singapore (SG); Kris Adriaenssens, Boortmeerbeek (BE); Pedro Vincent Vandecappelle, Wetteren (BE)

(73) Assignee: The Procter & Gamble Company, Cincinnati, OH (US)

( * ) Notice: Subject to any disclaimer, the term of this patent is extended or adjusted under 35 U.S.C. 154(b) by 332 days.

(21) Appl. No.: 14/151,937

(22) Filed: Jan. 10, 2014

(65) Prior Publication Data

US 2015/0196173 A1 Jul. 16, 2015

(51) Int. Cl.

| | |
|---|---|
| ***B67D 1/07*** | (2006.01) |
| ***A47K 10/38*** | (2006.01) |
| ***A47K 5/12*** | (2006.01) |
| *A47K 10/32* | (2006.01) |

(52) U.S. Cl.

CPC ..... *A47K 10/38* (2013.01); *A47K 5/1211* (2013.01); *A47K 10/3836* (2013.01); *A47K 2010/328* (2013.01); *A47K 2010/389* (2013.01)

(58) Field of Classification Search

CPC .. A47K 10/38; A47K 10/3836; A47K 5/1211; A47K 2010/328; A47K 2010/389

USPC ..... 222/192, 321.6–321.9, 181.1, 185.1

See application file for complete search history.

(56) References Cited

U.S. PATENT DOCUMENTS

| | | | | |
|---|---|---|---|---|
| 3,151,822 | A * | 10/1964 | Glaner | A47K 10/32 118/325 |
| 3,804,061 | A | 4/1974 | Cassar et al. | |
| 3,865,271 | A | 2/1975 | Gold | |
| 3,910,229 | A * | 10/1975 | Spencer | A47K 10/32 118/325 |
| 4,106,433 | A | 8/1978 | Asokan et al. | |
| 4,220,264 | A * | 9/1980 | Gamadia | B05B 9/0883 222/207 |

(Continued)

FOREIGN PATENT DOCUMENTS

| | | | |
|---|---|---|---|
| CN | 2172081 | Y | 7/1994 |
| CN | 101156755 | A | 4/2008 |

(Continued)

OTHER PUBLICATIONS

U.S. Appl. No. 14/310,023, filed Jun. 20, 2014, Hoefte, et al.
PCT Search Report dated Mar. 25, 2015; PCT/US2015/010718; 14 Pages.

*Primary Examiner* — Lien Ngo
(74) *Attorney, Agent, or Firm* — Larry L. Huston; Steven W. Miller

(57) ABSTRACT

A wet/dry sheet dispenser. The dispenser has an elongate refill which holds a liquid and fits into a complementary base. Liquid is selectively dispensed from the refill by longitudinal activation of a pump. The pump may be disposed on either the refill or base. Liquid flows from the refill, into the base and is ultimately dispensed onto a sheet. This arrangement allows for convenient and selective one hand pump operation, so the other hand is free to grasp the sheet. The sheet may be used wet or dry as desired at the point of use.

21 Claims, 12 Drawing Sheets

(56) References Cited

U.S. PATENT DOCUMENTS

| | | | | |
|---|---|---|---|---|
| 4,336,895 | A * | 6/1982 | Aleff | B05B 11/0016 222/207 |
| 4,436,224 | A | 3/1984 | McInerny | |
| 4,620,502 | A | 11/1986 | Kimble | |
| 4,667,846 | A | 5/1987 | Marceau | |
| 4,747,365 | A | 5/1988 | Tusch | |
| 4,798,312 | A | 1/1989 | Scheiber | |
| 4,858,788 | A * | 8/1989 | Meckenstock | B05B 9/0883 222/207 |
| 4,901,889 | A * | 2/1990 | Mitchell | A47K 10/32 222/153.11 |
| 5,433,084 | A | 7/1995 | Kaiser et al. | |
| 5,671,872 | A | 9/1997 | Daniels, Jr. | |
| 5,672,206 | A * | 9/1997 | Gorman | A47K 10/32 118/313 |
| 5,762,710 | A | 6/1998 | Looman et al. | |
| 5,819,989 | A | 10/1998 | Saraceni | |
| 5,829,278 | A | 11/1998 | Koo | |
| 5,887,759 | A | 3/1999 | Ayigbe | |
| 6,059,882 | A | 5/2000 | Steinhardt et al. | |
| 6,138,874 | A * | 10/2000 | Audrey | B05B 11/0005 221/45 |
| 6,314,971 | B1 | 11/2001 | Heub-Schneider et al. | |
| 6,319,318 | B1 | 11/2001 | Pekarek et al. | |
| 6,343,491 | B1 | 2/2002 | Jung | |
| 6,346,153 | B1 | 2/2002 | Kamps et al. | |
| 6,431,111 | B1 | 8/2002 | Zhang | |
| 6,431,405 | B2 | 8/2002 | Irwin | |
| 6,457,434 | B1 | 10/2002 | Lazar | |
| 6,497,345 | B1 | 12/2002 | Wilker et al. | |
| 6,547,881 | B1 | 4/2003 | Kloeckner | |
| 6,613,144 | B1 | 9/2003 | Loertscher et al. | |
| 6,918,513 | B1 | 7/2005 | Downey | |
| 7,018,473 | B2 | 3/2006 | Shadrach | |
| 7,185,841 | B2 | 3/2007 | Kaufmann | |
| 7,318,949 | B2 | 1/2008 | Shadrach | |
| 7,654,412 | B2 | 2/2010 | Amundson et al. | |
| 7,784,424 | B2 | 8/2010 | Wentworth et al. | |
| 7,850,041 | B2 | 12/2010 | Amundson et al. | |
| 7,856,941 | B2 | 12/2010 | Nelson et al. | |
| 7,984,832 | B2 | 7/2011 | Pivonka et al. | |
| 8,006,864 | B2 | 8/2011 | Fryan et al. | |
| 2003/0116588 | A1* | 6/2003 | Santagiuliana | B05B 11/3007 222/321.9 |
| 2005/0279652 | A1 | 12/2005 | Kushner | |
| 2007/0272701 | A1 | 11/2007 | Carlsson et al. | |
| 2008/0011782 | A1 | 1/2008 | Sidman | |
| 2009/0031952 | A1 | 2/2009 | Lazar | |
| 2009/0032636 | A1 | 2/2009 | Orlandi et al. | |
| 2009/0302049 | A1 | 12/2009 | Cornell | |
| 2010/0032443 | A1 | 2/2010 | Mueller et al. | |
| 2011/0088619 | A1 | 4/2011 | Duerrstein et al. | |
| 2011/0315715 | A1 | 12/2011 | Ophardt | |
| 2013/0126549 | A1 | 5/2013 | Ader | |
| 2013/0206789 | A1 | 8/2013 | Van Diepen et al. | |

FOREIGN PATENT DOCUMENTS

| | | | |
|---|---|---|---|
| DE | 3535330 | A1 | 4/1987 |
| DE | 29610683 | U1 | 6/1996 |
| DE | 19846375 | A1 | 4/2000 |
| DE | 20305272 | U1 | 9/2003 |
| DE | 102010036072 | A1 | 3/2012 |
| DE | 202011105459 | U1 | 3/2012 |
| EP | 0744147 | B1 | 5/2003 |
| FR | 2238457 | A1 | 2/1975 |
| WO | WO 2007/070898 | A1 | 6/2007 |
| WO | WO 2008/026132 | A2 | 3/2008 |

* cited by examiner

WET/DRY SHEET DISPENSER AND METHOD OF USING

FIELD OF THE INVENTION

The present invention relates to devices suitable for dispensing sheet products and more particularly to such devices which allow the user to select whether the sheets will be wet or dry at the point of use.

BACKGROUND OF THE INVENTION

Sheet dispensers are well known in the art. Some dispensers allow the user to dispense liquid in conjunction with dispensing sheets from the dispenser. Exemplary art is shown by U.S. Pat. Nos. 3,804,061; 4,436,224; 4,667,846; 4,798,312; 5,671,872; 5,762,710; 5,819,989; 6,138,874; 6,431,405; 7,018,473; 7,318,949; 7,850,041; 8,006,864; 2008/00117882; 2009/0302049; 2010/0032443; 2011/0315715; 2013/0126549; 2013/0206789 and DE 202011105459. But these attempts do not necessarily dispense the liquid directly to the sheet, potentially leading to inconvenience for the user.

Attempts to dispense the liquid directly to the sheet are found, for example, in U.S. Pat. Nos. 3,865,271; 4,106,433; 4,620,502; 4,74,7,365; 5,433,084; 5,672,206; 5,829,278; 5,887,759; 6,059,882; 6,319,318; 6,343,491; 6,431,111; 6,457,434; 6,497,345; 6,547,881; 6,613,144; 6,918,513; 7,185,841; 7,654,412; 7,856,941; 7,784,424; 2007/0272701; 2009/0031952; 2009/0032636; 2011/0088619; WO 200035327; WO 200587068; WO 2007070898; EP 1017303; EP 0744147; CN 2172081; CN 101156755; DE 29610683; DE 3535330; DE 19846375; DE 102010036072; DE 202011105459; DE 20305272; and FR 2238457. As can be seen, some of these attempts rely upon rollers or other means of direct contact of some portion of an apparatus with the sheet. Such an arrangement adds complexity to the apparatus and risks tearing the sheet by contact. Yet other attempts purportedly spray the liquid onto the sheet. But such attempts also rely upon complex apparatus, and may not have the flexibility desired by the user at the point of use.

A dispenser which allows for convenient sheet refill and for wet and dry sheets to be dispensed without contact with the apparatus is needed. But such an apparatus, without more, is not sufficient to meet everyday needs. Convenient refill of the liquid is also needed. And the dispenser must provide for convenient operation and a suitable liquid pattern on the sheet when a wet sheet is desired.

SUMMARY OF THE INVENTION

In one embodiment the invention comprises a refill for use in a sheet dispenser. The refill has a longitudinal axis defining a longitudinal direction. The refill comprises a reservoir having a hollow elongate body and an open neck. A valve is disposed in the neck and in fluid communication with the reservoir, whereby the valve can dispense liquid contained in the reservoir upon demand. A pump is juxtaposed in operable relationship with the valve and operates by compression in a longitudinal direction to dispense liquid from the reservoir to a manifold. The manifold has a nozzle opening disposed above the valve. The refill fits in a base. The base can hold and selectively dispense sheets upon demand. The base has a fitting juxtaposed with and in operable relationship with the valve. The fitting provides for the refill to be removably disposed in the base. Liquid dispenses from the nozzle opening onto one or more sheets being dispensed.

In another embodiment the invention comprises a dispenser having such a refill installed or installable therein. The refill may be filled with a liquid as presented to the user and/or may be refilled at the point of use without removing from the base.

DETAILED DESCRIPTION OF THE INVENTION

Figure 1B:
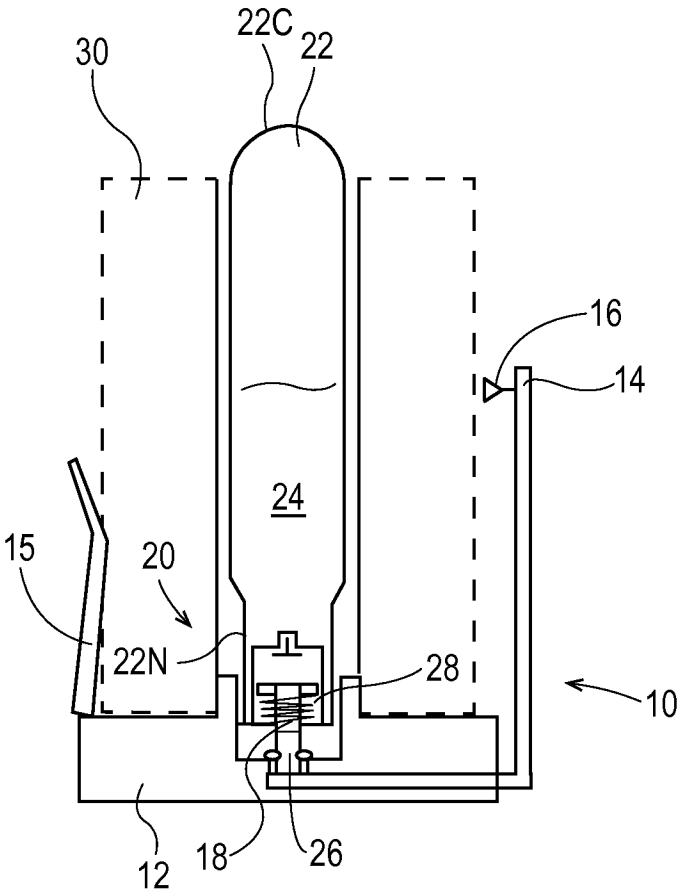
FIGS. 1A-1B are vertical sectional views, of a dispenser according to the present invention, with a core-wound roll of sheets shown in phantom being inserted and in place in the dispenser, respectively.
Figure 1A:
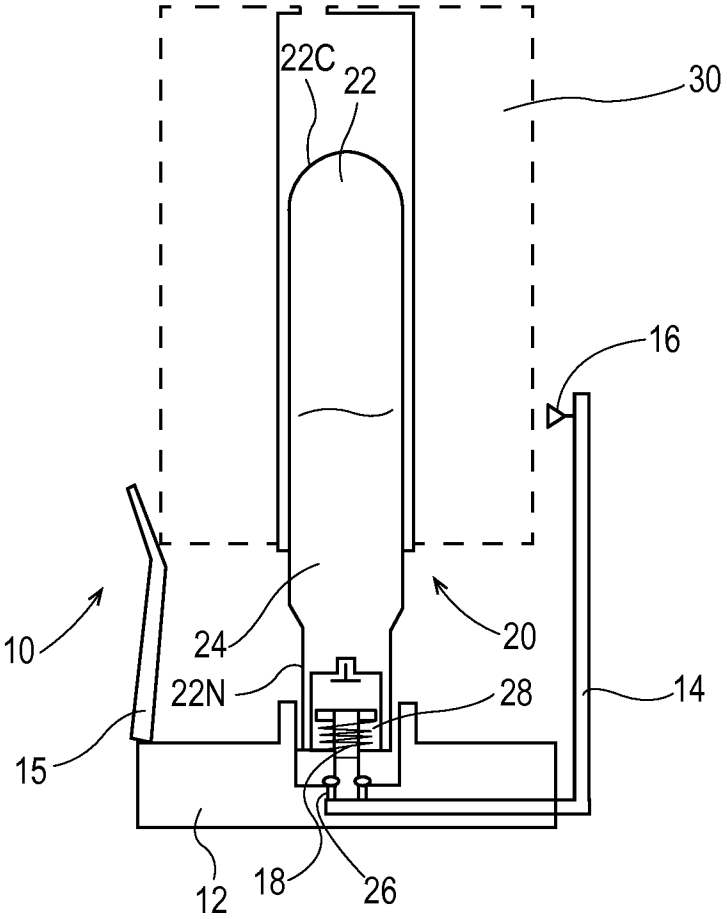
Figure 5:
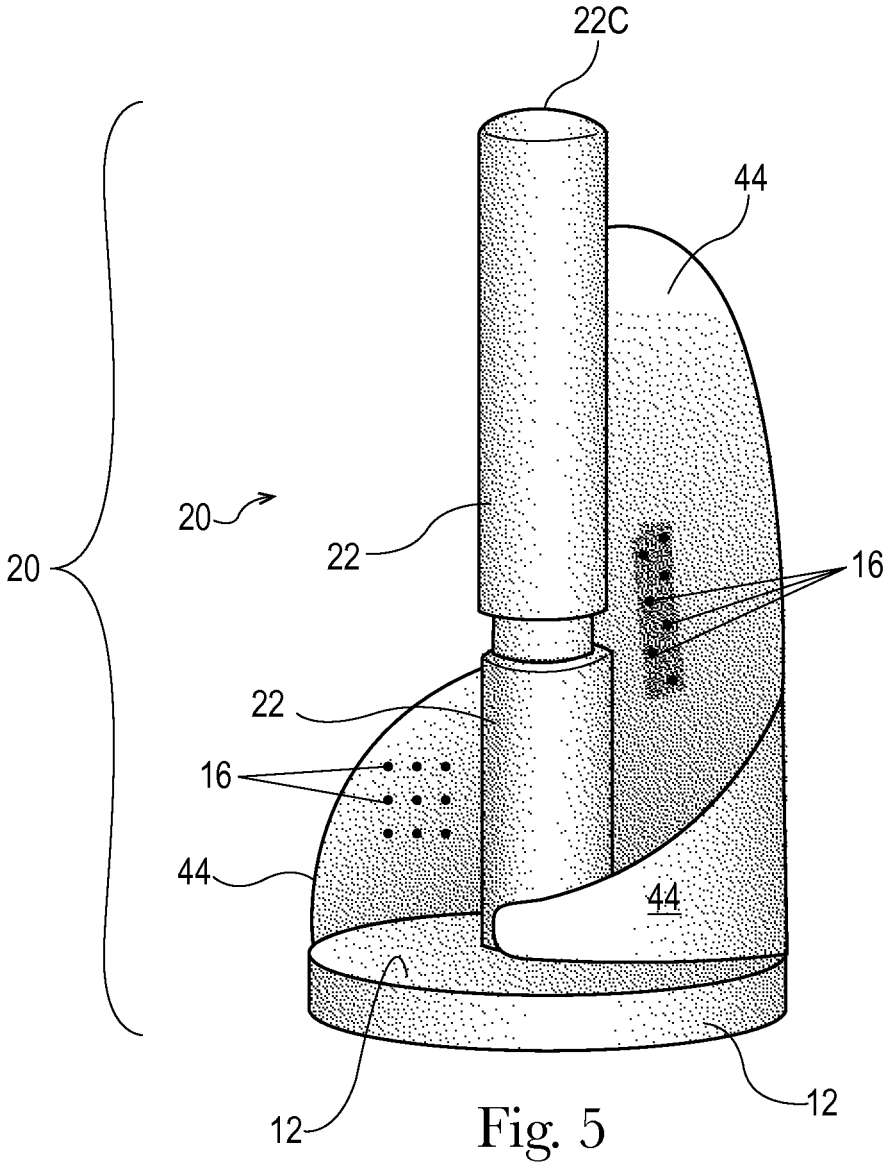
FIG. 5 is a perspective view of an alternative embodiment of a dispenser having a panel of nozzles fed by the manifold.

Referring to FIGS. 1A-1B and 5, in one embodiment the invention comprises a refill (20) usable in combination with, and as a component of, a sheet (30) dispenser (10). The dispenser (10) comprises the refill (20) and a base (12). The refill (20) may be removably disposable in and usable in conjunction with the dispenser (10). The refill (20) further comprises a reservoir (22) for holding a liquid (24) therein.

The dispenser (10) accepts a clip of sheets (30), which are later dispensed as needed. The dispenser (10) may further comprise a base (12) which acts as a frame for the remaining components, and may also comprise an external manifold (14). The manifold (14) disposes a nozzle (16) in a predetermined position for spraying liquid (24) from the reservoir (22) onto the sheet (30) in a predetermined pattern. The base (12) may optionally comprise a spindle [not shown] or stub for supporting the sheets (30)/refill (20).

The sheets (30) may be core wound as shown. Or the sheets (30) may be interfolded, as shown in commonly assigned U.S. Pat. No. 7,762,426, particularly FIGS. 4A-4E, or may be adhesively joined as shown in commonly assigned U.S. Pat. No. 5,520,308, particularly FIGS. 3A-3E. Either such configuration may provide pop up dispensing of the sheets (30). The base (12) may have a tab to help separate successive sheets (30) as shown in commonly assigned U.S. Pat. No. 5,810,200.

The refill (20) may be removably joined or coupled to the base (12). Particularly, a valve (18) in the refill (20) may be fluidly coupled to a fitting (26) in the base (12), so that liquid (24) may communicate from the reservoir (22) in the refill (20) to and through the nozzle (16) in the manifold (14).

A pump (28) is activated by the user, to selectively dispense liquid (24) from the reservoir (22) through the valve (18) in the refill (20) and into the manifold (14). The liquid (24) is dispensable upon demand by a user from the nozzle (16) in the manifold (14) to one or more sheets (30).

The base (12) may optionally comprise a clip (15). The clip (15) may be cantilvered from the base (12), as shown and provide spring force against the sheets (30). This arrangement provides the benefit that the sheets (30) are securely held in position during use.

Figure 1C:
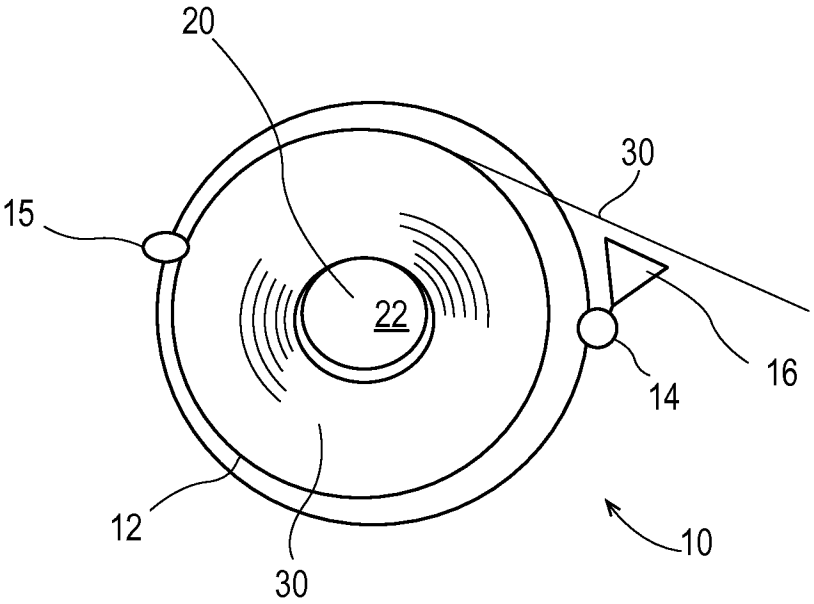
FIG. 1C is a top plan view of the dispenser and sheets of FIGS. 1A-1B, showing a hollow core and the sheets in solid, with a leader. The sectional views shown here are taken from FIG. 1C.

Referring to FIG. 1C, and examining the invention in more detail, the sheets (30) may be core wound, as is known in the art. The sheets (30) may comprise cellulose and/or synthetic fibers, as known. The sheets (30), and particularly sheets (30) comprising cellulose, may be usable as bath tissue, facial tissue, paper toweling, dish washing sheets (30), toilet paper, other hygienic sheets (30), etc. Sheets (30) comprising synthetic nonwoven materials may be usable as solid/soft surface wipes, floor cleaning sheets (30), baby wipes, facial wipes, dryer added fabric enhancers, etc. Cellulosic sheets (30) may be made with discrete or continuous high density regions, as part of the drying process. More particularly, cellulosic sheets (30) may be made according to commonly assigned patents: U.S. Pat. Nos. 3,974,025; 4,191,605; 4,239,065; 4,529,480; 4,637,859; 5,364,504 and/or 5,529,664. Synthetic nonwoven sheets (30) may be hydroentangled to impart texture, carded, spunbond, etc., as are known in the art. Synthetic nonwoven sheets (30) may have latex, mechanical bonds and/or thermal bonds to impart desired physical properties. More particularly, synthetic sheets (30) may be made according to commonly assigned patents: U.S. Pat. Nos. 6,101,661; 6,645,604; 6,651,354, and optionally contain absorbent gelling materials as described in commonly assigned U.S. Pat. No. 5,960,508. Any of the aforementioned sheets (30) may comprise a single layer or a laminate of plural like or different layers. The sheets (30) may be pre-wetted. A pre-wetted sheet (30) may be made according to commonly assigned U.S. Pat. No. 6,716,805.

While a core wound plurality of sheets (30) is shown, one of skill will recognize the invention is not so limited. The sheets (30) may be horizontally stacked or disposed in an inverted U-shape, as are known in the art. The sheets (30) may be vertically stacked as shown in commonly assigned U.S. Pat. No. 7,762,426, FIG. 2 and column 7, lines 18-30. The sheets (30) may be interleaved/separably joined, e.g. with adhesive, as shown therein at FIGS. 4A-5E and columns 7, lines 31-65. The sheets (30) may be joined together with perforations.

All such forms of sheet (30) dispensing are known, usable with, and not critical to the claimed invention. One of skill will recognize that the refill (20) may be sold with or without the liquid (24) and/or with or without the sheets (30).

The sheets (30) may be dry or may be pre-wettted with a first liquid (24). Another liquid (24) may be dispensed onto the dry or pre-wetted sheet (30) at the point of use. The liquid (24) usable with the present invention may be aqueous, contain alcohol, solvents, surfactant, perfumes, disinfectants, etc. The liquid (24) may be usable as a hard/soft surface cleanser, particularly a dish cleanser, fabric cleanser, disinfectant, germicide, bacteriacide, insect repellant, etc. Optionally, the sheets (30) may contain a dry chemistry which is activated when the liquid (24) is dispensed onto the sheet (30). This arrangement provides the benefit that efficacy is not depleted and remains available at the point of use. Optionally, the reservoir (22) may contain two liquids (24) which are kept separate until intermixed at the point of use.

Figure 2B:
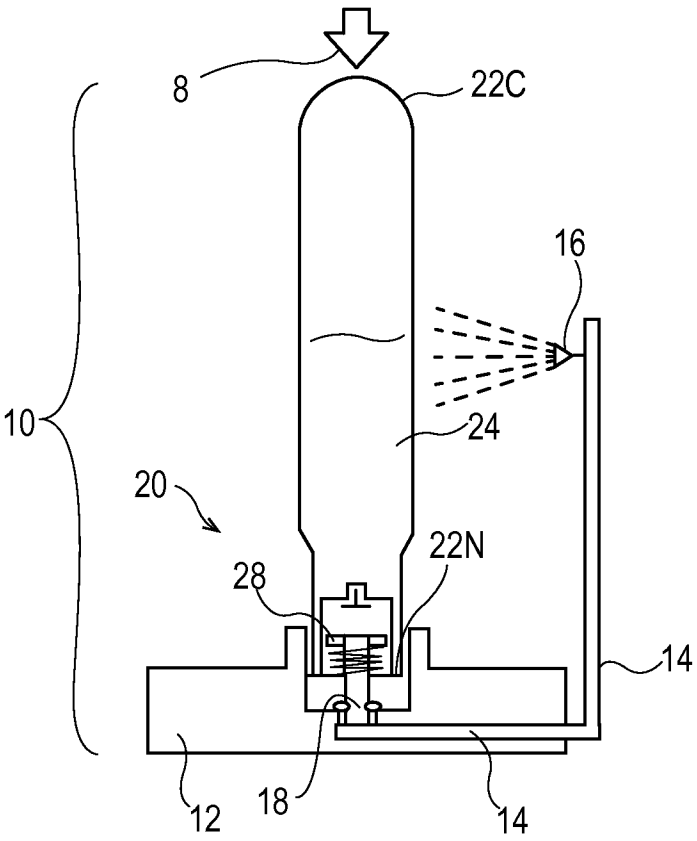
FIG. 2B is a vertical sectional view, of the dispenser of FIG. 2A showing the refill being installed in base.
Figure 2A:
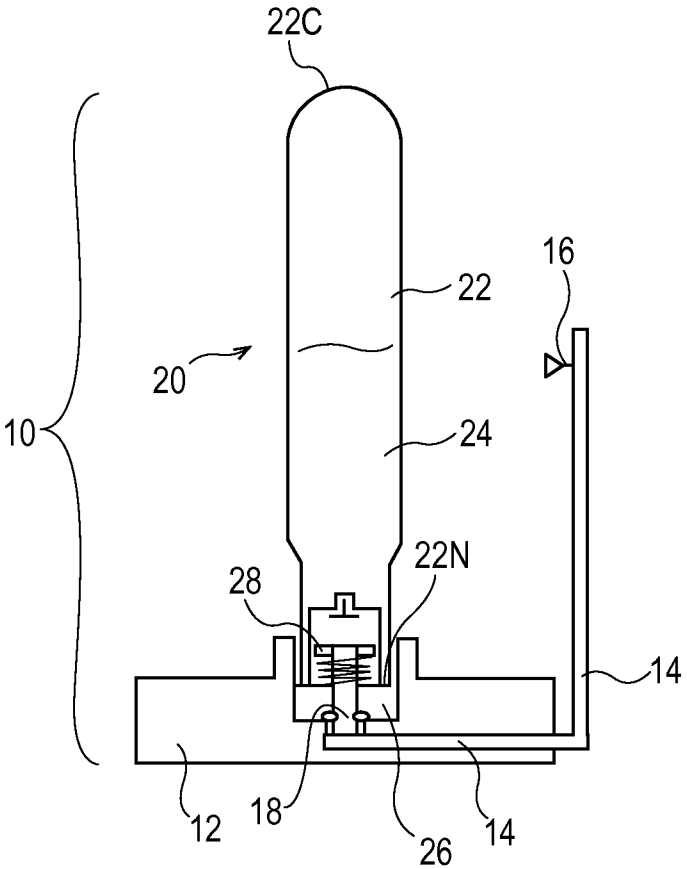
FIG. 2A is a vertical sectional view, of the dispenser of FIGS. 1A-1B showing the refill being installed in the dispenser and having the clip removed for clarity.

Referring to FIGS. 2A-2B, the refill (20) may be elongate, axi-symmetric having a vertical axis. The refill (20) may comprise a hollow body which acts as a reservoir (22) to contain at least 10, 20, or 25, but not more than 350, 300, 200, or 100 cc of liquid (24) therein. One end (22C) of the body may comprise a closed or closable end (22C). The other end (22C) of the body may comprise an open neck (22N), through which liquid (24) may be dispensed. The closed end (22C) may be disposed above a discharge valve (18), to provide for easy, one handed operation as described herein. The dispenser (10) further comprises a pump (28), which may be disposed in the refill (20) or on the dispenser (10) base (12). Optionally the base (12) may comprise an axially coincident spindle and the refill (20) fit complementary thereon for stability.

The body may be made of plastic, such as PET, or metal, etc. The refill (20) may have a total length of at least 10, 15 or 20 cm, and not more than 50, 40 or 30 cm, and comprise any suitable cross section. The cross section may be constant, stepped, variable, concentric and/or eccentric about the longitudinal axis. If a round cross section is selected, it may have a nominal diameter of 2 to 5 cm. The entire refill (20) may be rigid, the body may be rigid, or the body may flex in response to axially applied loads used to activate the pump (28).

The base (12) and refill (20) may fit together through a lock and key system as is known in the art. This arrangement minimizes the likelihood of an improper refill (20) being used, potentially reducing damage and/or leakage. The refill (20) may have a separate lock and key system to prevent replenishing liquid (24) therein from an improper or undesirable supply. This arrangement provides the benefit that the user does not inadvertently use the wrong cleanser. For example, referring to FIGS. 8A-8C, the refill (20) may have a lock and key system which is common to both the base (12) and to replenishment from an external supply.

The refill (20) may be filled with the liquid (24) as presented to the user. When the refill (20) is depleted, it may be discarded and replaced with a refill (20) having a fresh supply of liquid (24). Alternatively, the refill (20) may be replenished with liquid (24) from a separate supply by the user. The body may further comprise a vent, as known, to prevent drawing a vacuum upon dispensing. A headspace may be disposed above the liquid (24).

FIGS. 2A-2B show the pump (28) may be contained in the refill (20). The pump (28) may be juxtaposed with, and, in a degenerate case, disposed in, the neck (22N) of the refill (20). The pump (28) may dispense liquid (24) through the manifold (14) in response to longitudinal actuation of the refill (20), i.e. pushing upon the refill (20) to apply compressive force directed to the base (12), as indicated by the arrow in FIG. 2B. The pump (28) may comprise an inlet valve (18), compression chamber and discharge valve (18) as known in the art. Compressive pressure applied to the head space may force liquid (24) through the pump (28) system under pressure and into the manifold (14), as indicated by the arrow in FIG. 2B. A return spring brings the pump (28) back to a starting position when the user applied force is released. The pump (28) may provide a constant dose of liquid (24) each time it is activated. Alternatively, the pump (28) may be adjustable as is known in the art to provide a larger or smaller dose as desired.

Figure 2C:
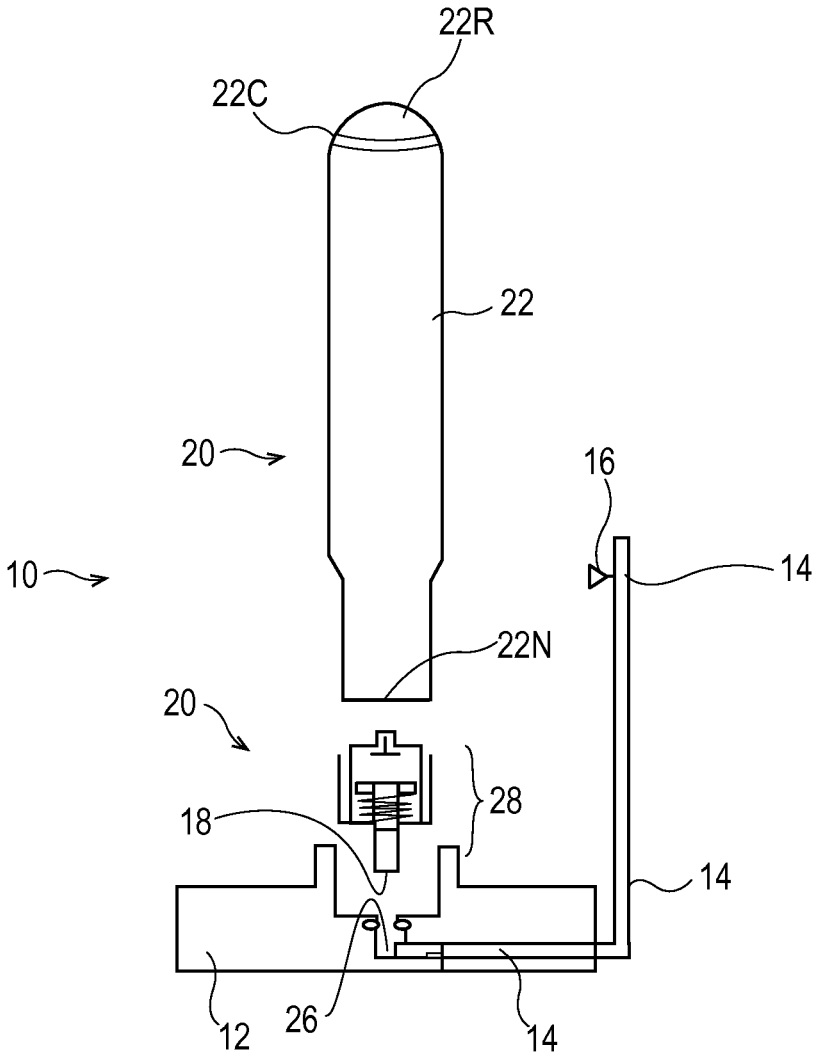
FIG. 2C is an exploded vertical sectional view of the refill of FIGS. 2A-2B and further having a reclosable opening in the closed end of the refill.

Referring to FIG. 2C, the pump (28) assembly may be disposed in either the neck (22N) of the refill (20) or in the base (12). Disposing the pump (28) in the refill (20) provides the benefit that the pump (28) may be tailored to the specific rheological properties of the liquid (24) contained in the refill (20). Disposing the pump (28) in the base (12) provides the benefit that the refill (20) has fewer components and is less expensive. If the pump (28) is disposed in the base (12), the refill (20) may have a reclosable opening (22R) in the neck (22N) to prevent spillage during transportation, storage, insertion, etc. The reclosable opening (22R) may fit into a complementary receptacle in the base (12). In either configuration, a valve (18) may be removably disposed in the neck (22N) to allow for selective dispensing of the liquid (24), as the pump (28) is activated.

A discharge valve (18) may be disposed in the neck (22N) of the receptacle. The discharge valve (18) provides for release of the liquid (24) to the manifold (14) under pressure, upon actuation of the pump (28) by the user. The base (12) may comprise a fitting (26), which acts as a complementary receptacle for the valve (18) and/or neck (22N). This complementary arrangement allows the refill (20) to be removably installed in the base (12), as desired and the reservoir (22) to be in fluid with communication with the base (12), through the nozzle (16).

With continuing reference to FIGS. 2A-2C, the manifold (14) may be external to the base (12). The manifold (14) may have one or more spray nozzles (16), to provide for dispensing of the liquid (24) into the atmosphere and optionally directly on the sheet (30). By being sprayed directly onto the sheet (30), less liquid (24) is misplaced or oversprayed onto the countertop or other undesired areas. As used herein, spray includes atomized droplets, a liquid stream, foam, gel, heavy droplets, etc.

The manifold (14) may have a single spray nozzle (16) as shown, or plural nozzles (16). A single nozzle (16) provides the benefit of concentrated spray. Plural nozzles (16) provide the benefit of covering more of the sheet (30). Plural nozzles (16) may provide for similar or different coverage patterns/amounts of sprayed liquids (24). A check valve (18) may be disposed between plural nozzles (16), to minimize priming. The nozzle[s] (16) may be disposed at least 1 to 50, but not more than 40 to 50 cm above the base (12). The nozzles[s] (16) may be disposed below the closed end (22C) of the refill (20).

The manifold (14) may be longitudinally oriented as shown, may wrap the sheets (30) in a spiral, or be of any other desired geometry. The manifold (14) may be cantilevered from a proximal end disposed on the base (12) and extend to a distal end disposed above the base (12) and towards the closed end (22C) of the refill (20). The sheets (30) may be dispensed in a first direction or dispensing direction, radial to and outward from the longitudinal axis. The manifold (14) may be generally orthogonal to such dispensing direction, to advantageously allow for coverage of the dispensed liquid (24) onto select portions of the sheet (30). A manifold (14) having vertically aligned nozzles (16) and a horizontal/radial sheet (30) dispensing direction is prophetically judged to be advantageous. Such nozzles (16) may spray in any desired direction and particularly perpendicular to a radius from the longitudinal axis.

If desired, the manifold (14) may have one or more liquid (24) permeable membranes in addition to or in place of the nozzle[s] (16). This arrangement allows the user to touch the sheet (30) to the permeable membrane, thereby wetting the sheet (30).

Referring to FIGS. 3A-3E, in another embodiment, the pump (28) may be juxtaposed with, and, in a degenerate case, disposed at, the closed end (22C) of the refill (20). Such a pump (28) may comprise a diaphragm which axially compresses the head space in response to axial force applied by the user coincident the longitudinal axis and applied towards the base (12).

Figure 3A:
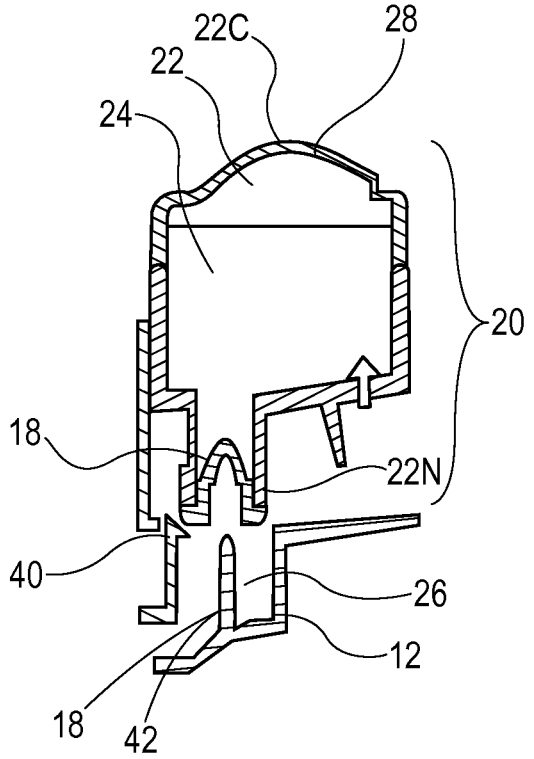
FIGS. 3A-3E are vertical sectional views of an exemplary refill being installed in the dispenser.
Figure 3B:
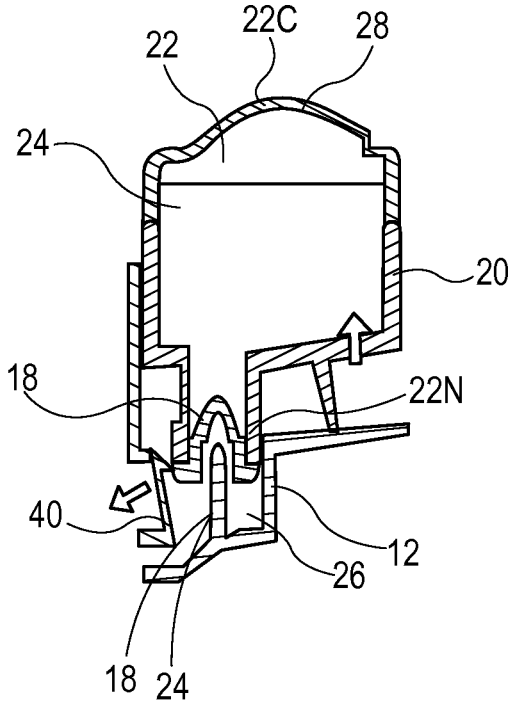
Figure 3C:
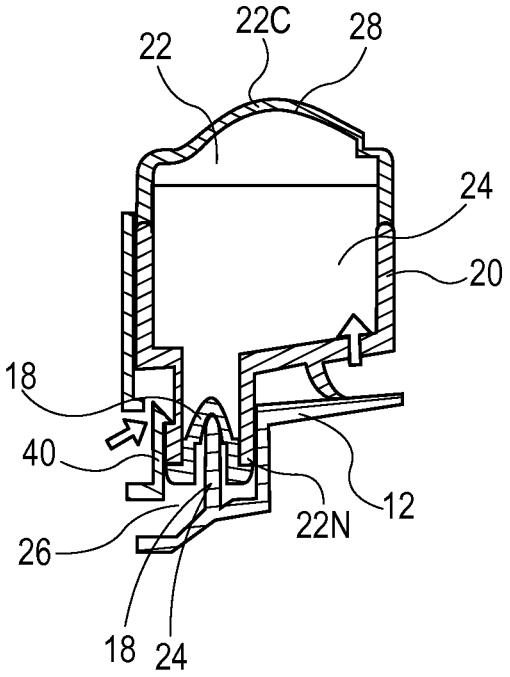

Particularly, FIG. 3A shows the refill (20) separated from and being inserted into the base (12). FIG. 3B shows a latch (40) intercepting the neck (22N) of the refill (20) upon insertion into the base (12). The latch (40) prevents unintended removal of the refill (20) from the base (12) during use. FIG. 3C shows a needle (42) piercing a neck (22N) seal of the refill (20). The needle (42) may be part of the base (12). The neck (22N) seal may comprise TPE, silicone, rubber or other material which self-seals around the needle (42). FIG. 3C also shows the latch (40) in place, mechanically holding the refill (20) and base (12) together.

Figure 3D:
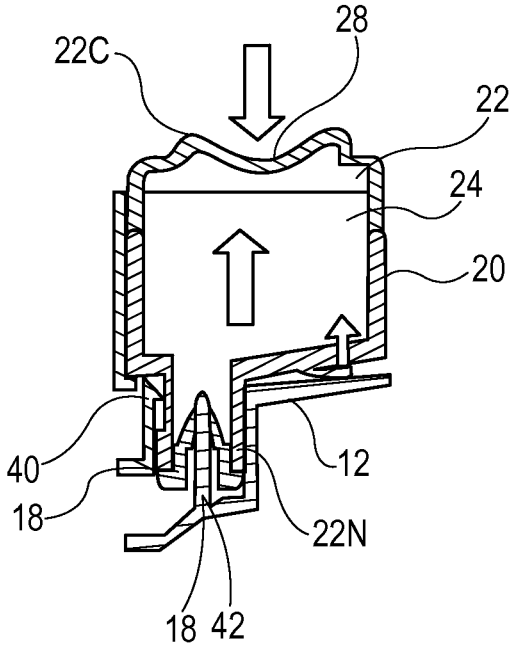
Figure 3E:
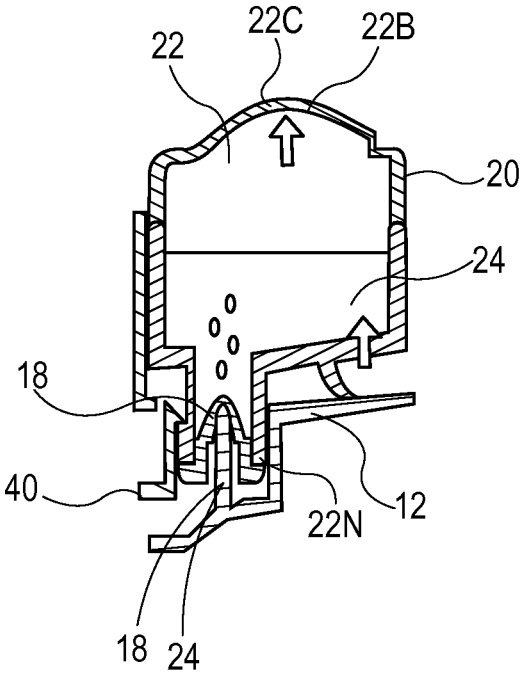

FIG. 3D shows the pump (28) being selectively activated in the axial direction towards the base (12). Liquid (24) flows through the penetration around the needle (42) and into an inlet of the manifold (14) [not shown]. FIG. 3E shows the pump (28) being returned to the starting position. Further discharge of the liquid (24) does not occur. Expansion of the head space draws air in through the vent, as is known in the art. A return spring elevates the seal above the needle (42), minimizing leakage or unintended dispensing. The dispensing process may then be selectively repeated, as desired.

Figure 4:
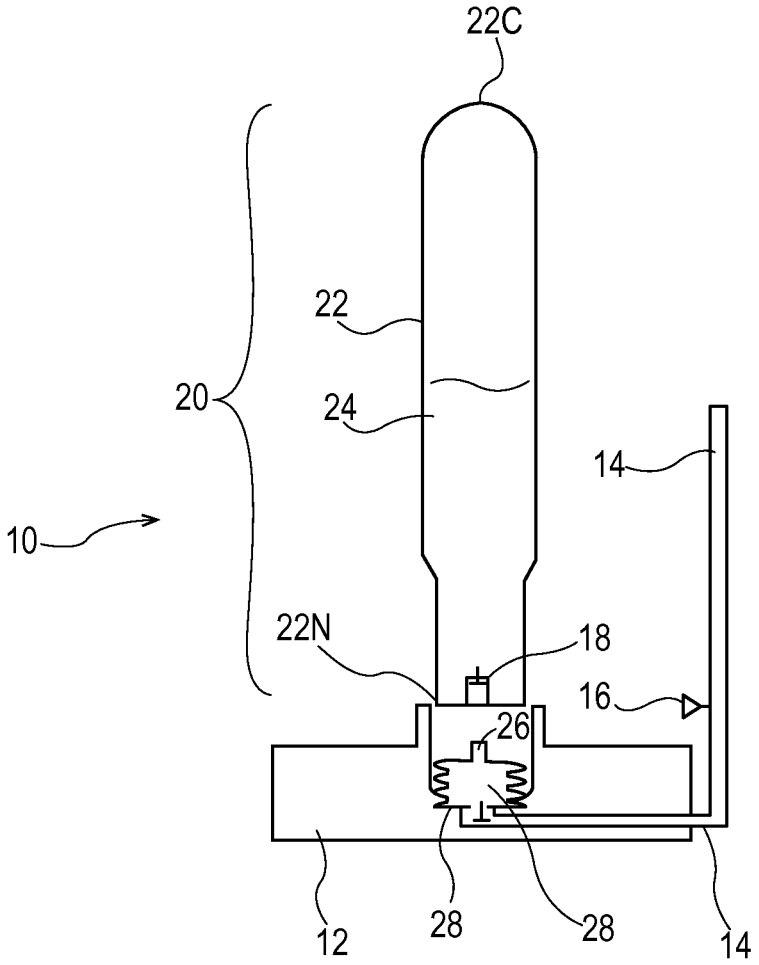
FIG. 4 is a vertical sectional view of an alternative embodiment of the refill and dispenser according to the present invention and having a bellows pump, showing the refill and dispenser separated.

Referring to FIG. 4, if desired the pump (28) may comprise a bellows. The bellows may be disposed in the base (12) as shown, or alternatively may be disposed in the neck (22N) of the refill (20). In this configuration, the refill (20) may be rigid, i.e. not deform under longitudinally applied user compressive forces. Liquid (24) may flow through an inlet valve (18), into the bellows. The compressive force applied by the user collapse the bellows, forcing the liquid (24) under pressure through the discharge valve (18) and into the manifold (14). Upon release of the vertical, axial, compressive force applied to the refill (20), the bellows expands, drawing vent air into the refill (20) as described above.

The pump (28) may have an axial displacement, manifested as a stroke of 0.3 cm to 10 cm, and particularly 0.5 to 5 cm, under user applied manual actuation force. The pump (28) may dispense at least 0.1, 0.5, 1 or more cc of liquid (24) upon each actuation and may dispense not more than 10, 5 or 4 cc with each dose. The actuation force may range from 5 to 40N, particularly in the downward vertical direction. The pump (28) may have a discharge force of 10 to 40 N. The liquid (24) may have a rheology of at 10 $s^{-1}$ of 1 to 100, 500 or 1000 cps, or 100-200 cps to accommodate typical dish washing liquids. A pump (28) providing these performance properties with such a liquid (24) has been found advantageous for dispensing, e.g. dish washing liquids (24), so that the present invention may be advantageously and conveniently used in the kitchen.

Viscosity is determined by conventional methods, e.g. using an AR 1000 rheometer from TA Instruments of New Castle, Del. using a standard-size aluminum DIN or double wall concentric cylinder. The high shear viscosity at 10 s−1 is obtained from a logarithmic shear rate sweep at 20° C. The procedure consists of two steps including a pre-conditioning and a flow ramp up step. The pre-conditioning step is a pre-shear at 10 s−1 and 20° C. for 30 sec. The flow ramp up follows immediately and consists in shearing the sample at increasing shear rates in steady state flow mode from 0.1 to 1000 s−1, for 5 points per decade on a logarithmic scale, allowing measurements to stabilize for a period of from 5 s for up to 1 min with a tolerance of 5 percent. The logarithmic plot of the viscosity vs. shear rate of the flow ramp down experiment is used to determine the high shear viscosity at 10 s−1.

Referring to FIG. 5, the manifold (14) may comprise one or more panels (44). One or more of these panels (44) may comprise a plurality of nozzles (16). These nozzles (16) may be arranged in a grid or any other desired pattern. This arrangement provides the benefit that a relatively larger spray pattern may be utilized. The nozzles (16) may provide equivalent or differential amounts of liquid (24) spray. The nozzles (16) may provide a conical spray pattern, fan shaped spray pattern or other pattern as desired. Plural nozzles (16) may provide identical, similar or different spray patterns.

Figure 6B:
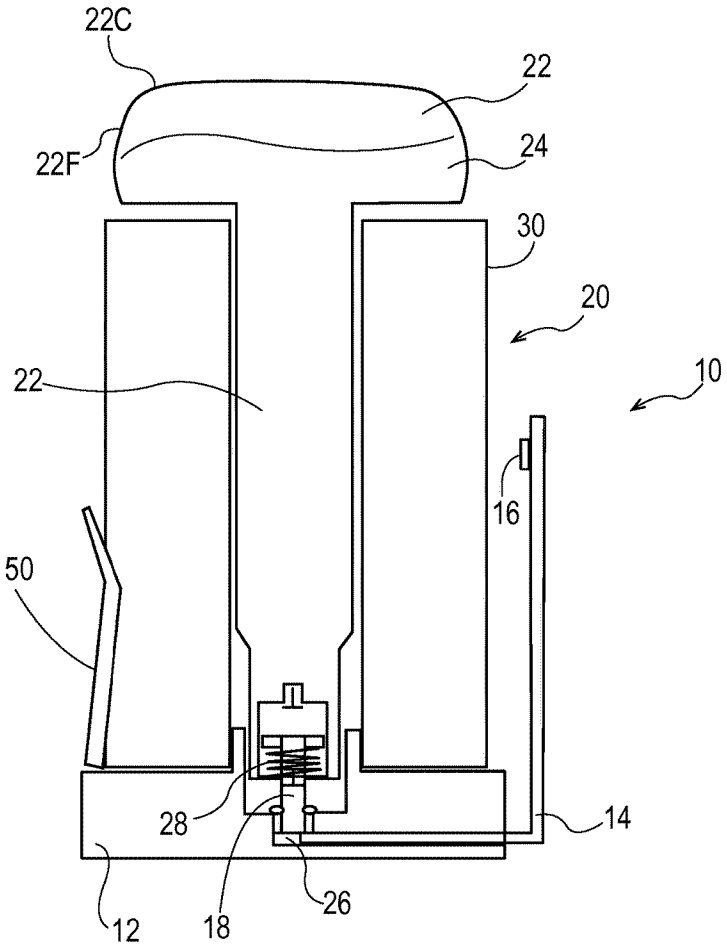
FIG. 6B is a vertical sectional view of an alternative embodiment of the refill and dispenser according to the present invention and having an enlarged reservoir with an upper flare, showing the refill and base joined.
Figure 6A:
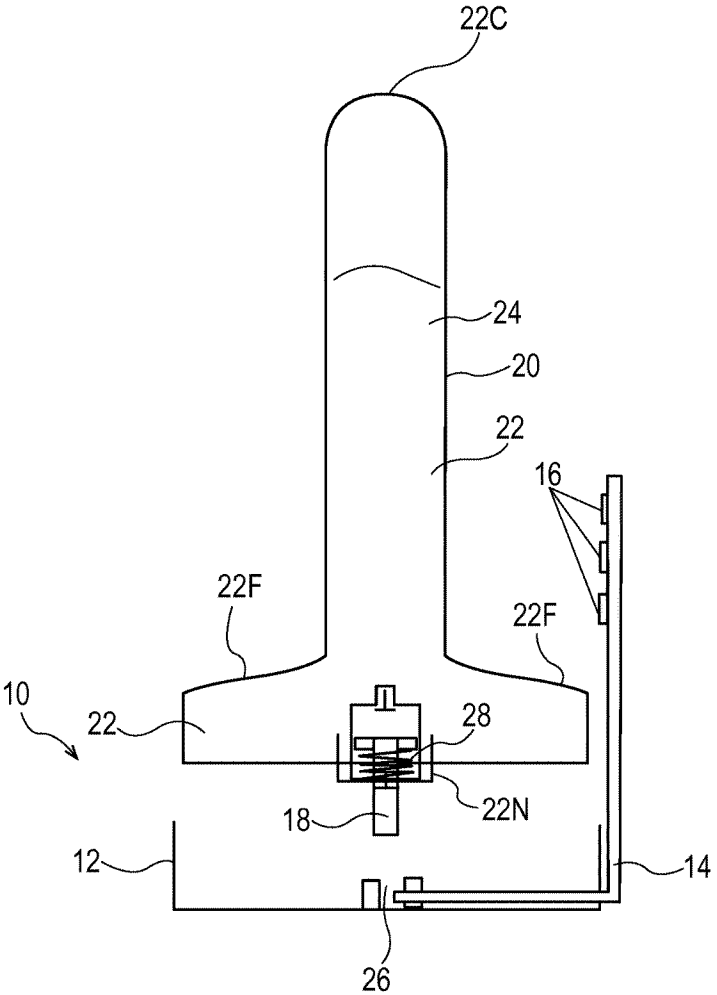
FIG. 6A is a vertical sectional view of an alternative embodiment of the refill and dispenser according to the present invention and having a enlarged reservoir with a lower flare, showing the refill and base separated.

Referring to FIG. 6A, the reservoir (22) may have a flare (22F) juxtaposed with the base (12), partially surround or completely circumscribe the longitudinal axis and/or extend radially outward therefrom. The flare (22F) may provide for increased reservoir (22) volume, storage of two phase or immiscible liquid (24) supply, etc. This arrangement provides the benefit of increase stability, by lowering the center of gravity when there is liquid (24) within the reservoir (22). The flare (22F) may optionally be concentric the longitudinal axis, for balance.

Referring to FIG. 6B, the flare (22F) may be at the top of the refill (20). This arrangement provides the benefit that the sheets (30) may be more securely held in place.

Figure 7:
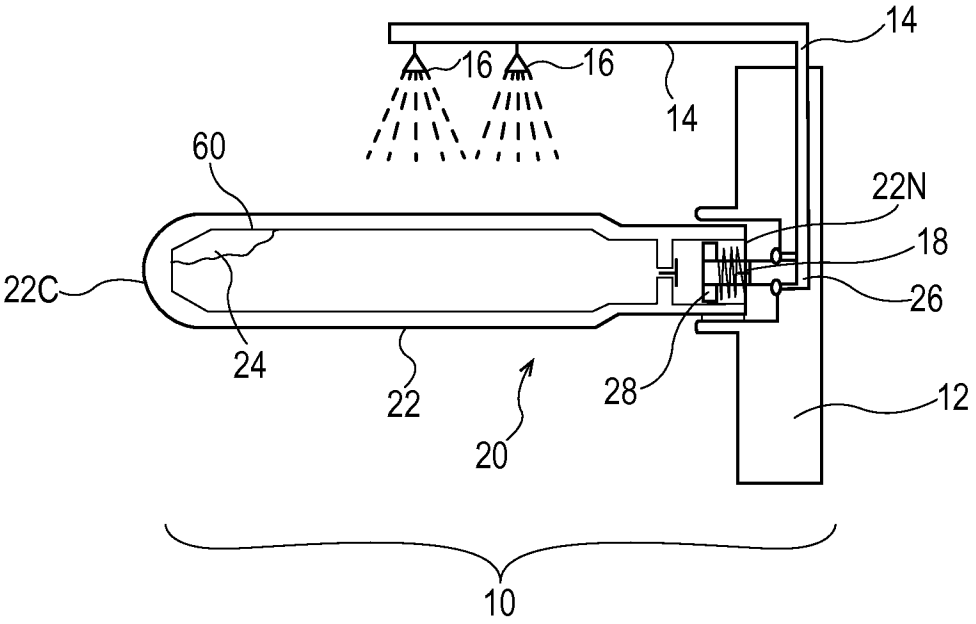
FIG. 7 is a side elevational view of an alternative embodiment of the refill and dispenser according to the present invention, having a horizontal longitudinal axis and dual nozzles.

Referring to FIG. 7, if desired the longitudinal axis may be disposed generally horizontal. This arrangement provides the benefit that the dispenser (10) may be wall mounted or fit into other spaces without requiring a countertop. FIG. 7 also shows that the refill (20) may contain an internal bladder 60. The bladder 60 contains the liquid (24) and collapses as liquid (24) is dispensed therefrom. This arrangement provides the benefit that contact of the liquid (24) with the air is reduced, potentially slowing degradation.

Figures 8A, 8B, 8C:
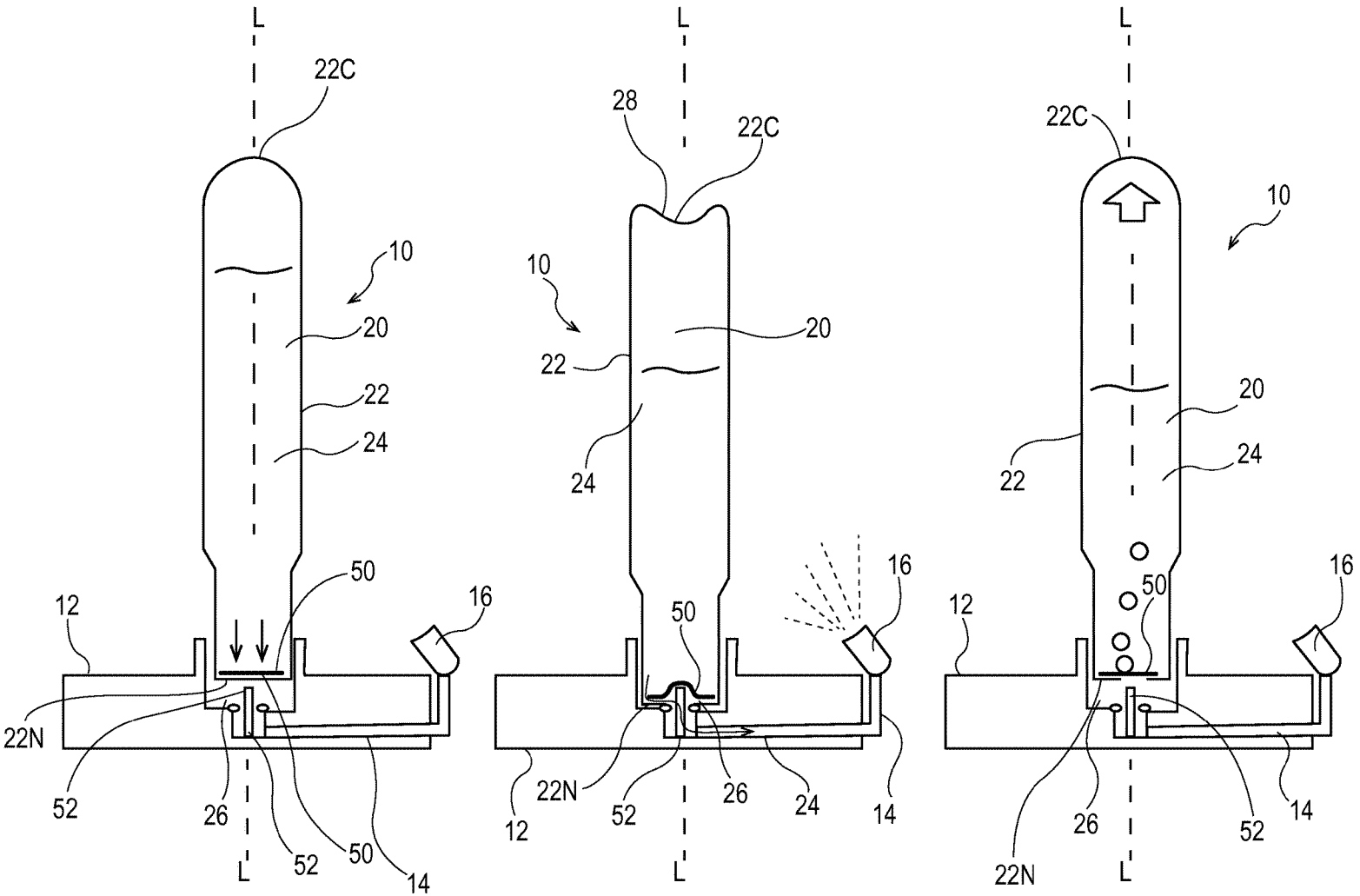
FIGS. 8A-8C are vertical sectional views of an alternative embodiment of a refill having a pump integral with the refill.

Referring to FIGS. 8A-8C, the pump (28) may be integral with the refill (20). In such an embodiment, the pump refill (20) may have a resiliently deformable closed end (22C) or other resiliently deformable section along the longitudinal axis L-L. The user depresses or otherwise applies longitudinally axial compression to the pump (28), compressing the head space above the liquid (24).

Compressing the head space moves a deformable platform (50) onto a post (52). The deflection of the platform (50) breaks the seal against the neck (22N), allowing liquid (24) to flow into the manifold (14). Release of the integral pump (28), allows the pump (28) to return to the starting position.

The pump (28) could be powered by an electric motor if desired. The electric motor could be battery powered or powered by an AC outlet. The pump (28) could be triggered by a motion sensor or proximity sensor, as disclosed in 2013/0206789, particularly para. 19. Using an electric pump (28) allows one to use a bag or other flaccid material for the refill (20). If desired, the refill (20) may contain two, three or more reservoirs (22) of liquid (24). This arrangement provides flexibility for the user to select a different liquid (24) for different needs, e.g. lotion for application from the sheet (30) to the skin, polish to protect a shoe, anti-bacterial cleanser for a countertop, a different perfume, etc.

The claimed arrangement avoids the need for a dispenser (10) having an internal piston. Also, by placing the manifold (14)/nozzle (12) combination on the base (12), the need for, and recurring expense of a nozzle (12) on the refill (20) is avoided.

In use, the user grasps a sheet (30) with one hand and removes it from the supply of sheets (30) disposed on the dispenser (10). The user may grasp a plurality of sheets (30), if desired. The user's other hand is free, if wetting is desired, to activate the pump (28). If pump (28) activation is desired only a single hand is needed to axially activate the pump (28) by compression thereof towards the base (12). This arrangement neither requires the complex piston assemblies, externally movable parts which can become entangled with sheets (30), clothing etc., nor undue manipulation of a pump (28) as occurs in the prior art. The pump (28) action requires action in only a single, longitudinal direction for selective wet/dry dispensing.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

All documents cited in the Background and in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to the term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A refill for use in a sheet dispenser, said refill having a longitudinal axis defining a longitudinal direction, said refill comprising:

a reservoir, said reservoir comprising a hollow elongate body and an open neck;

a valve disposed in said neck and in fluid communication with said reservoir, whereby said valve can dispense liquid contained in said reservoir upon demand;

said valve being fluidly connectable to a fitting, said fitting being disposed in a base and juxtaposed with and in operable relationship with said valve, said fitting providing for said refill to be removably disposed in said base, which base can hold and selectively dispense sheets therefrom; and a pump juxtaposed with said valve and operable in said longitudinal direction to dispense liquid from said reservoir through said valve to a manifold in fluid communication with said base, said manifold being in fluid communication with said fitting and having a nozzle disposed remote from said fitting for spraying liquid therefrom.

2. A refill according to claim 1 wherein said valve is removably disposed in said neck.

3. A refill according to claim 1 having a closed end remote from said neck opening, said closed end having a reclosable opening therethrough for admitting liquid into said reservoir for later dispensing in response to pumping by a user.

4. A refill according to claim 1 wherein said pump comprises a bellows disposed in said neck, said bellows providing at least a portion of said fitting.

5. A refill according to claim 4 having a longitudinal dimension of 10 to 50 cm and wherein said pump has a longitudinal stroke of 0.5 to 5 cm.

6. A refill according to claim 5 wherein said pump has a net discharge force of 10 to 40 N.

7. A refill according to claim 3 having a first cross section juxtaposed with said fitting and a second cross section juxtaposed with said closed end, said second cross section being greater than said first cross section.

8. A refill according to claim 7 having a generally round cross section, said cross section having a first diameter juxtaposed with said fitting and a second diameter juxtaposed with said closed end, said second diameter being greater than said first diameter.

9. A refill according to claim 1 wherein said reservoir further comprises a flare juxtaposed with said valve and extending radially outward therefrom.

10. A refill according to claim 9 wherein said flare circumscribes said longitudinal axis.

11. A dispenser for selective wet/dry dispensing of sheet products, said dispenser having a longitudinal axis and comprising:

a base for receiving a plurality of sheets thereon, said sheets being selectively dispensible by a user;

a refill disposed on said base, said refill having a longitudinal axis defining a longitudinal direction, said refill comprising:

a reservoir, said reservoir comprising a hollow elongate body and an open neck;

a valve disposed in said neck and in fluid communication with said reservoir, whereby said valve can dispense liquid contained in said reservoir upon demand;

a fitting disposed in said base, said fitting being juxtaposed with and in operable relationship with said valve, said fitting providing for said refill to be removably disposed in said base;

a pump juxtaposed with said valve and operable to dispense liquid from said reservoir to a cantilevered manifold, said cantilevered manifold having a nozzle opening juxtaposed with said valve, said manifold being in fluid communication with said fitting, said manifold and extending upwardly from said base and being juxtaposed therewith, and at least one nozzle disposed on said manifold, whereby liquid can be sprayed from said nozzle onto a sheet dispensed from said base in response to user activation of said pump.

12. A dispenser according to claim 11 wherein said base has a center, and said reservoir comprises a longitudinally oriented spindle, said spindle being juxtaposed with the center of said base to receive a roll of sheet products thereon.

13. A dispenser according to claim 12 wherein said reservoir has a closed end remote from and disposed above said valve, and said at least one nozzle is disposed 5 to 40 cm above said base and below said closed end.

14. A dispenser according to claim 11 further comprising a lock and key system complimentary to said refill and said base, whereby said lock and key system prevents said refill from being used with a base not complementary thereto and/or prevent said base from accepting a refill not complementary thereto.

15. A dispenser according to claim 14 wherein said refill further comprises a reclosable opening for replenishment of liquid from a supply to said reservoir, said refill further comprising a second lock and key system whereby said second lock and key system prevents said refill from being replenished with liquid from a supply not complementary thereto.

16. A dispenser according to claim 12 further comprising a panel, said panel being juxtaposed with a sheet being dispensed from said dispenser, said panel comprising a plurality of nozzles thereon in fluid communication with said reservoir and directed to spray a liquid pattern onto a sheet being dispensed.

17. A refill for use in a sheet dispenser, said refill having a longitudinal axis defining a longitudinal direction, said refill comprising:

a reservoir, said reservoir comprising a hollow elongate body and an open neck;

a valve disposed in said neck and in fluid communication with said reservoir, whereby said valve can dispense liquid contained in said reservoir upon demand;

said valve being fluidly connectable to a fitting disposed in a base, which base can hold and selectively dispense sheets therefrom, whereby said refill can be removably disposed in the base; and a pump disposed in said base, said pump being operable by compression of said refill in a longitudinal direction to dispense liquid from said reservoir through said valve and said fitting, in order, to a manifold, said manifold being in fluid communication fitting and having a nozzle disposed remote from said valve.

18. A refill according to claim 17 wherein said valve comprises a normally closed check valve, said check valve being openable in said longitudinal direction upon operation of said pump.

19. A refill according to claim 17 wherein said valve is disposed in said open neck and is directly fluidly connectable to a fitting, said fitting being disposed on a pump disposed in said base.

20. A refill according to claim 19, said refill being incompressible between said open neck and said closed end.

21. A dispenser for selective wet/dry dispensing of sheet products, said dispenser having a longitudinal axis and comprising:

a base for receiving a plurality of sheets thereon, said sheets being selectively dispensible by a user;

a refill disposed on said base, said refill having a longitudinal axis defining a longitudinal direction, said refill comprising:

a cantilevered reservoir, said cantilevered reservoir comprising a hollow elongate body and an open neck;

a valve disposed in said neck and in fluid communication with said reservoir, whereby said valve can dispense liquid contained in said reservoir upon demand;

a fitting disposed in said base, said fitting being juxtaposed with and in operable relationship with said valve, said fitting providing for said refill to be removably disposed in said base;

a pump juxtaposed with said valve and operable to dispense liquid from said reservoir to a manifold, said manifold having a nozzle opening juxtaposed with said valve, said manifold being in fluid communication with said fitting, said manifold and extending upwardly from said base and being juxtaposed therewith, and at least one nozzle disposed on said manifold, whereby liquid can be sprayed from said nozzle onto a sheet dispensed from said base in response to user activation of said pump.

* * * * *